United States Patent [19]

Kurita et al.

[11] Patent Number: 4,993,983

[45] Date of Patent: Feb. 19, 1991

[54] MOBILE TOY HAVING MULTIPLE SIREN SOUNDS AND BODY TYPES

[75] Inventors: Toshiaki Kurita; Akihisa Hatakeyama, both of Tokyo, Japan

[73] Assignee: Tomy Company, Ltd., Tokyo, Japan

[21] Appl. No.: 554,922

[22] Filed: Jul. 20, 1990

[30] Foreign Application Priority Data

Aug. 8, 1989 [JP] Japan ..... 1-93170[U]

[51] Int. Cl.[5] ..... A63H 17/00; A63H 33/26; A63H 5/00; A63H 29/24

[52] U.S. Cl. ..... 446/94; 446/93; 446/130; 446/272; 446/463

[58] Field of Search ..... 446/95, 94, 129, 130, 446/270, 272, 409, 463, 470, 88, 93, 436

[56] References Cited

U.S. PATENT DOCUMENTS

| | | | |
|---|---|---|---|
| 4,116,084 | 9/1978 | Masuda | 446/463 |
| 4,152,866 | 5/1979 | Suda | 446/463 |
| 4,274,225 | 6/1981 | Knauff | 446/409 |
| 4,938,730 | 7/1990 | Yamane | 446/130 |
| 4,940,442 | 7/1990 | Matsuda | 446/95 |

*Primary Examiner*—Robert A. Hafer
*Assistant Examiner*—David J. Kenealy
*Attorney, Agent, or Firm*—Staas & Halsey

[57] ABSTRACT

A mobile toy includes a plurality of body shells, each being shaped to resemble a different vehicle type, a chassis to which any one of the plurality of body shells is selectively and detachably coupled; and siren sound generating means, mounted on the chassis, for producing a plurality of siren sounds, each being selectable to correspond to a selected and coupled one of the plurality of body shells.

18 Claims, 3 Drawing Sheets

MOBILE TOY HAVING MULTIPLE SIREN SOUNDS AND BODY TYPES

BACKGROUND OF THE INVENTION

1. Field of the Invention:

The present invention relates generally to mobile toys and, more specifically, to mobile toys such as vehicles which issue a siren sound.

2. Description of the Related Art:

It has been known to provide a toy ambulance, patrol car, etc. with siren sound generating devices. However, in the past, each different vehicle type is provided with a singular type of siren sound so that multiple vehicles would be required for a child to experience and play with vehicles having siren sounds.

SUMMARY OF THE INVENTION

An object of the present invention is to provide a mobile toy capable of producing multiple types of siren sounds corresponding to multiple types of vehicles.

Another object of the present invention is to provide a mobile toy in which a common chassis is used to alternatively mount multiple body types, wherein a siren sound can be selected from multiple siren sounds based on the selected body type.

Another object of the present invention is to provide a mobile toy which is capable of allowing play of a plurality of ambulance vehicles with the use of only one chassis.

These and other objects of the invention are met by providing a mobile toy having a plurality of body shells, each being shaped to a different vehicle type, a chassis to which any one of the plurality of body shells is selectively and detachably coupled, and sound generating means, mounted on the chassis, for producing a plurality of siren sounds, each being selectable to correspond to a selected and coupled one of the plurality of body shells.

Preferably, the siren sound generating means includes a voice synthesizing integrated circuit, a speaker, and a plurality of sounding switches for allowing the selective issuance of a predetermined siren sound. The sounding switches are adapted to be engaged with projecting pieces which are projected from the body shells at positions shifted from each other so as to be closed to issue a siren sound corresponding to a vehicle type mounted on the chassis.

When a body shell is mounted on the chassis, a projection projected from the body shell is engaged with a sounding switch by which a siren sound corresponding to a vehicle type of body shell is generated, so as to close the switch, thus making it possible to issue siren sounds corresponding to a plurality of vehicle types.

These and other features and advantages of the mobile toy of the present invention will become more apparent with reference to the following detailed description and drawings.

DETAILED DESCRIPTION OF THE PREFERRED EMBODIMENT

Figure 1:
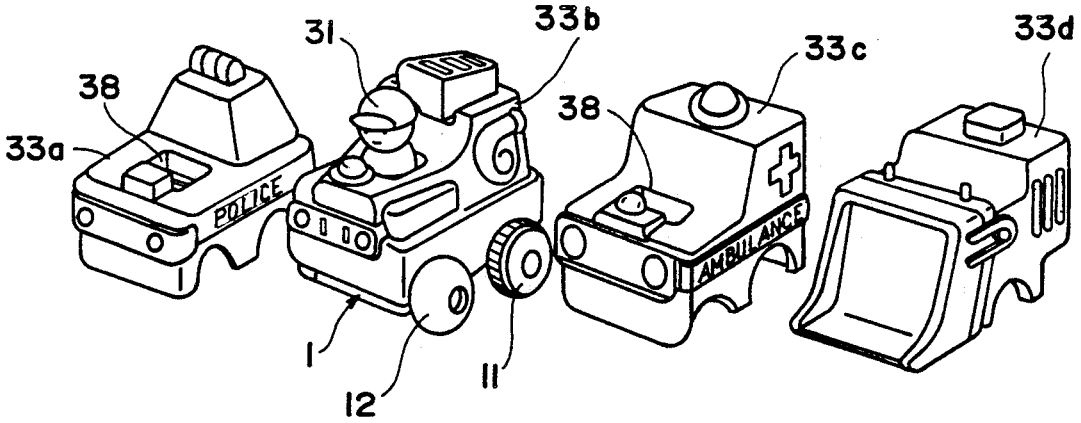
FIG. 1 is a perspective view showing a mobile toy according to the present invention, with multiple body shells of different vehicle types.

Referring now to FIG. 1, a plurality of body shells 33*a*, 33*b*, 33*c*, and 33*d* are illustrated, with body shell 33*b* illustrated to be coupled to a chassis 1. Each body shell has a shape which is different from the others, such that body shell 33*a* is shaped to resemble a police patrol car, body shell 33*b* is shaped to resemble a fire truck, body shell 33*c* is shaped to resemble an ambulance, and body shell 33*d* is shaped to resemble a bulldozer. In real life, each of these vehicle types produce a different type of siren or warning sound. Therefore, the toy vehicles or mobile toys according to the present invention produce a different sound for each different vehicle type, although the different sounds issue from a common chassis 1, as will be described below.

Figures 5A, 5B, 5C, 5D:
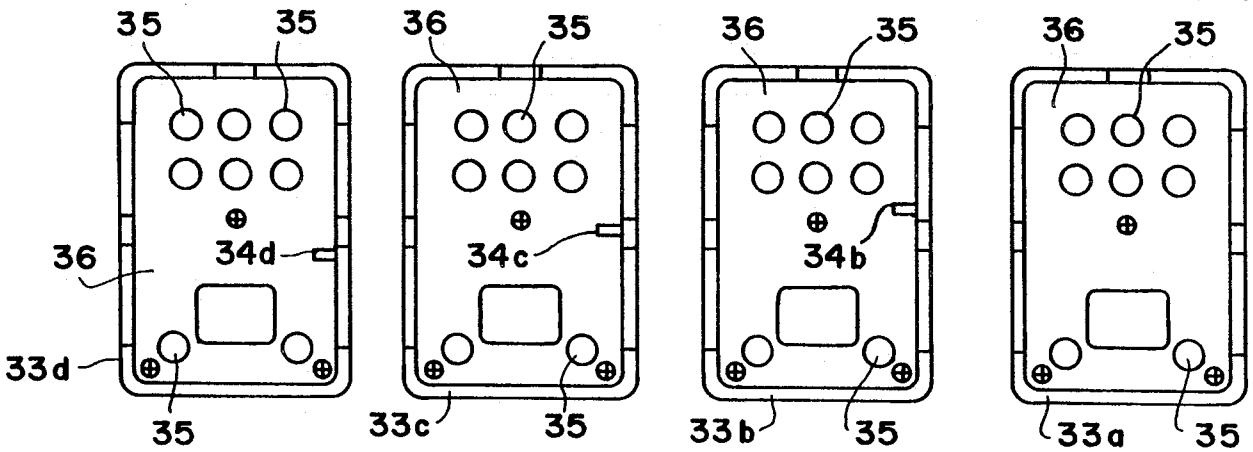
FIGS. 5(*a*)–5(*d*) are bottom views of the plurality of body shells illustrated in FIG. 1.

The body shells 33*a*, 33*b*, 33*c* and 33*d* all have hollow interiors and an open lower end which is fitted over the top of the chassis 1. As shown in FIGS. 5(*a*)–5(*d*), a partition plate 36 is mounted in each body shell in a direction transverse to the opening, and each partition plate has a plurality of circular recesses 35 formed therein.

Figure 2:
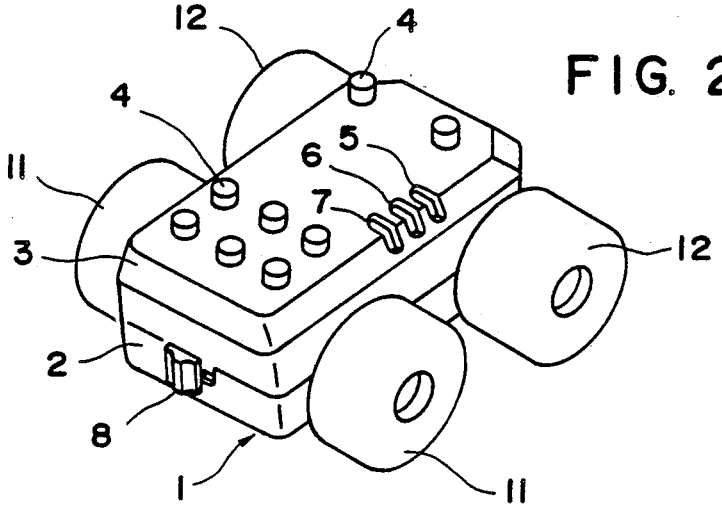
FIG. 2 is an enlarged perspective view of a chassis common to the various body shells illustrated in FIG. 1.

As shown in FIG. 2, the chassis 1 has a box-like construction of generally rectangular shape, and includes lower shell half 2 and upper shell half 3 which are joined together by conventional means, such as snap fitting or adhesive or heat bonding.

A plurality of projections 4 are formed in a pattern on the upper surface of the upper shell half 3. The pattern of projections 4 coincides with the pattern of recesses 35 formed in the partition plates 36 of the body shells 33*a*–33*d*. Thus, the patterns of recesses and projections provide means for detachably coupling any one of the plurality of body shells to the chassis 1. The upper shell half 3 also includes three slots 5, 6 and 7 formed transversely in one of the longitudinal edges of the upper shell half 3. These slots are spaced apart longitudinally.

Figure 3:
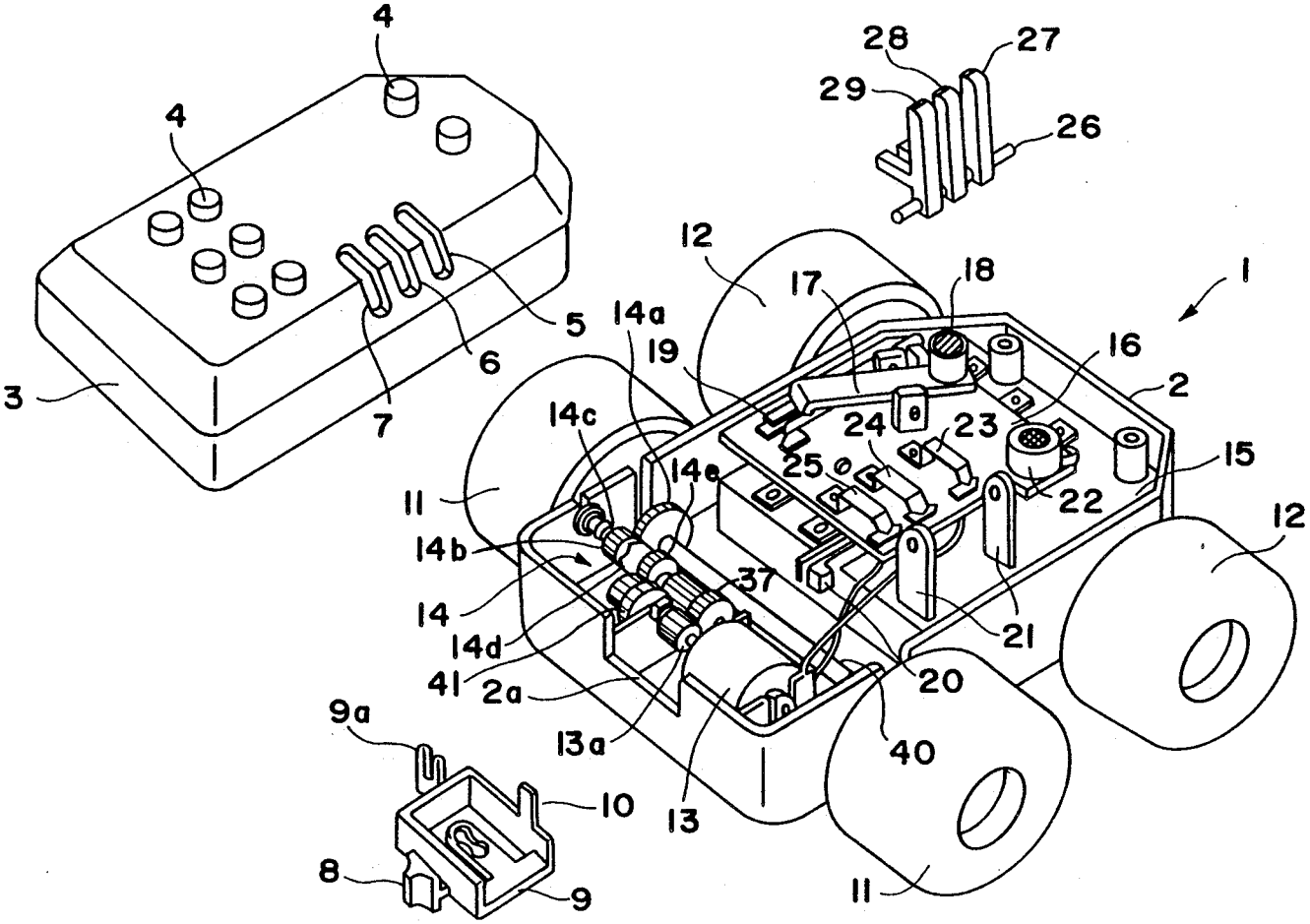
FIG. 3 is a further enlarged, exploded and perspective view of the chassis of FIG. 2.

Referring now to FIG. 3, the chassis 1 is illustrated with the upper shell half 3 removed, thereby exposing the interior of the chassis. A motor 13 coupled to transmission gearing 14 are mounted in the lower shell half 2, with the transmission gearing 14 transmitting power from the motor 13 to the drive wheels 11. A battery storage compartment 15 is formed in the bottom section of the lower shell half 2. A printed circuit board 16 is mounted on an upper surface of the battery compartment 15. The printed circuit board 16 includes a voice synthesizing integrated circuit (I.C.) 30 (illustrated in FIG. 6). The I.C. 30 incorporates a semiconductor memory device which stores voice data of a plurality of siren sounds. The voice synthesizing I.C. 30 transmits, when sounding switches (to be described below) are activated or closed. Thus, voice signals are delivered to a speaker 22 through an amplifier so as to allow a predetermined siren sound to be issued.

Three electroconductive contact pieces 23 (providing a first switch) 24 (providing a second switch), and 25 (providing a third switch) are disposed on the upper surface of the printed circuit board 16 and arranged in a row longitudinally of the chassis 1. A support shaft 26 carries three L-shaped pivotal levers 27, 28 and 29, with the support shaft 26 being journalled between a pair of vertical support arms 21. The contact pieces 23, 24 and 25 form normally open switches, whereby through a spring bias in the metal conductive strips which form the contact pieces, distal end portions of the strips are normally lifted upwardly from a corresponding contact plate of the circuit board 16. The L-shaped pivotal levers 27, 28 and 29 are mounted to bear upon the contact pieces 23, 24 and 25, respectively so as to close the normally open switches when the levers are pushed downwardly. Thus, the contact pieces and the pivotal levers corresponding thereto constitute the sounding switches of the present invention.

A knob 8 extends outwardly from a rear surface of the chassis 1 through an opening 2*a* provided in the lower shell half 2 of the chassis 1. The knob 8 includes an integrally formed slide member 9 which is slidable in the lower shell half 2. The slide member 9 is slidable beneath the transmission gearing 14 and has a projection 9*a* provided on one end surface of the slide member 9. The projection 9*a* has a slot formed therein which receives a gear 37 of the transmission gearing. A projecting arm 10 extends upwardly from an upper region of the slide member 9 and is arranged so as to be engageable with one of a pair of electroconductive contact pieces 20 which are electrically coupled to the motor 13. When the knob 8 is slid in the left direction (when viewed from FIG. 3), one of the pair of electroconductive contact pieces which is engaged by the projecting arm 10 is pushed into contact with the other of the pair of electroconductive contact pieces 20 and thus the motor 13 becomes electrically coupled to the battery power source so that the motor is driven. Moreover, the gear 37 which is fitted in the slot of the projection 9*a* slides so as to mesh with another one of the transmission gears so as to establish a condition of a coupled drive train so that the rotational output of the motor 13 is transmitted to the drive wheels. In contrast, when the knob 8 is slid in the opposite direction, the pair of electroconductive contact pieces 20 separate and the gear 37 is slid to the right so as to release it from the other gearing so that the drive wheels 11 become uncoupled to the motor 13 and to the substantial portion of the transmission gearing 14, so that the drive wheels 11 are in a free-rotation condition, or in a "neutral" condition. In this condition, the mobile toy can be run by pushing and coasting, as opposed to being driven by an electric motor.

The transmission gearing 14 includes a gear 14*a* which is rotatable with an axle 40 which carries the wheels 11. The gear 14*a* meshes with a ratchet gear 14*b* which is urged by a spring 14*c* into engagement with a hub 14*d* of gear 14*e*. Gears 14*c*, 14*e* and 37 are mounted on a common axle, with the gear 14*e* being fixedly connected to the axle, while gears 14*b* and 37 are rotatable freely on the axle. The motor 13 has an output pinion gear 13*a* which has elongated splines which mesh with the gear teeth of gear 37. The gear 37 is slidable along the length of its support shaft by movement of the knob 8. Movement of the gear 37 is affected by the gear 37 fitting between the two upstanding portions of the projection 9*a*. Thus, when the knob 8 is in the righthand-most position, the gear 37 is pushed to the right by virtue of the outer-most arm of the projection 9*a* pushing against the inner flat surface of the gear 37. When the gear 37 is moved to the right, a smaller diameter splined portion of the gear 37 is moved out of engagement with gear 41. Gear 41 has a smaller diameter portion which meshes with gear 14*e* so that the drive train is uninterrupted when the gear 37 is pushed to the left by the knob 8. FIG. 3 illustrates gear 37 in the left-side position, whereby the gear train is uninterrupted. When the knob is pushed to the right and the gear 37 follows, the smaller diameter splined portion of the gear 37 becomes disengaged from the gear 41, so that the drive train is interrupted. This has the advantage that the electric motor 13 is uncoupled to the drive train so that the vehicle can be pushed or rolled easily.

The ratchet gear 14*b* acts as a slip-coupling so that if the mobile toy runs into an obstruction such that the wheels 11 resist rotation, rotation of the gear 14*e* by the motor 13 will cause the ratchet gear 14*b* to be pushed outwardly against the spring 14*c* so that rather than rotating, the gear 14*b* is pushed axially by the jagged end face of the hub 14*d*.

As shown in FIG. 1, the body shell 33*d* having the shape of a fire truck is mounted on the chassis 1. As shown in FIG. 5(*a*), the body shell 33*d* has a projection 34*d* which is positioned to fit into the chassis 1 through the slot 7 so as to engage the pivotal lever 29, which pivots so as to cause the electroconductive piece 25 to complete an electrical circuit. This results in the voice synthesizing I.C. transmitting a voice signal to issue a siren sound of a fire truck so as to allow the speaker to issue the siren sound of the fire truck.

When the body shell 33*a* (shown in FIG. 5(*d*)) is attached to the chassis 1, there is no projection which is capable of closing the sound switches 23, 24 or 25. Accordingly, if the body shell 33*a* is mounted on the chassis 1, all of the switches are left open. In this condition, upon energization, the voice coil I.C. 30 is set to transmit a voice signal for issuing a siren sound of a police control car. Accordingly, the siren sound of the patrol car issues from the speaker 22.

When the body shell 33*c* (shown in FIG. 5(*b*)) is mounted on the chassis 1, the projecting piece 34*c* fits in to the slot 6 formed in the upper surface of the chassis 1, thus causing an engagement with the pivotal lever 28 which moves the contact piece 24 into a closed position. In the closed position, the voice synthesizing I.C. 30 transmits a voice signal of an ambulance car through the speaker 22.

When the body shell 33*b* (shown in FIG. 5(*c*)) is placed on the chassis 1, a projection 34*b* fits into the slot 5 provided in an upper surface of the upper shell half 3 so as to engage the pivotal lever 27 which in turn closes the switch 23. In this condition, the voice synthesizing I.C. 30 transmits a voice signal for issuing a "warning sound" of the bulldozer. The warning sound issues from the speaker 22.

Figure 4:
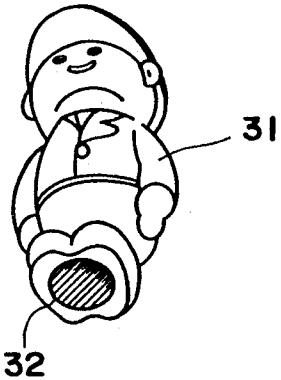
FIG. 4 is a bottom perspective view of a doll which forms a part of the mobile toy according to the present invention.

In the illustrated embodiment, there is an additional power on/off switch which includes two pairs of electroconductive contact pieces 19 which are normally in an open condition. A lever 17 is pivotally mounted on the circuit board 16, and carries at one hand a permanent magnet 18, while the opposite end is turned downwardly to provide a movable abutment which causes the contact pieces 19 to close when the pivotal lever 17 is caused to pivot. The pivotal lever 17 is caused to pivot by placing a doll 31 (shown in FIG. 4) on an outer surface of the body shell. The base portion of the doll 31 is provided with magnetic material 32 which attracts the permanent magnet 18 by magnetic force. Due to this attraction, the lever 17 pivots as the permanent magnet 18 approaches the base of the doll 31. The opposite end of the pivotal lever 17 moves downwardly to force the contact pieces 19 into electrical contact, thus completing the electrical circuit. Thus, according to the illustrated embodiment, the doll 31 has the added feature of the mobile toys requiring a "driver" to be placed thereon before the vehicles will move.

The contact pieces 19 may alternatively be used instead of the contact pieces 20, so that operation of the vehicle can be initiated merely by placing the doll 31 on the vehicle. Thus, with respect to the knob 8, the arm 10 would not be necessary.

As a further alternative, the gear 37 could be placed in the drive train permanently and the knob 8 could be avoided altogether by using the contact pieces 19. However, this embodiment would leave the drive train permanently coupled to the electric motor 13 so that coasting or rolling without the motor could not be effected.

The voice synthesizing I.C. is commercially available and is designated by the product number U.M. 3561. Other circuit components illustrated in FIG. 6 are commercially available, and circuit values, such as the resistor values are well within the purview of the skilled practitioner.

Referring to FIG. 3, it can be seen that the contact pieces 23, 24 and 25 have electroconductive spring arms which contact electroconductive plates provided on the printed circuit boar 16. In the alternative, a wiring pattern may be provided on the circuit board which essentially is patterned to have an open circuit or break in the wiring. The pivotal levers 27, 28 and 29 can then be provided with a conductive member at their distal ends so that when the pivotal levers are pivoted downwardly by the projections of the corresponding body shells, the circuit is closed by the conductive member which contacts the wiring pattern provided on the printed circuit board 16.

Figure 6:
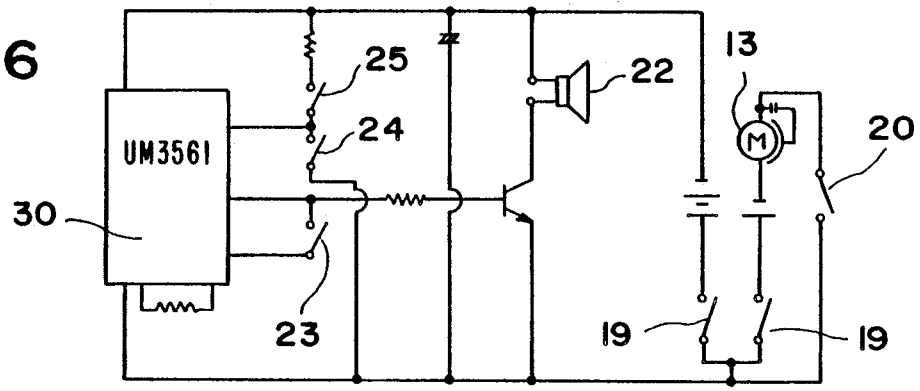
FIG. 6 is a schematic wiring diagram illustrating the siren sound generating means according to the present invention.

The wiring diagram illustrated at FIG. 6, which corresponds to the structure illustrated in FIG. 3 allows the possibility that, when the switch 20 is open, the siren sound can nevertheless be emitted by closing the switch 19. Since the switches 19 are closed simultaneously, if the switch 20 is left open only the siren sound will issue and the motor 13 will not be energized.

Numerous modifications and adaptations of the present invention will be apparent to those so skilled in the art and thus, it is intended by the following claims to cover all such modifications and adaptations which fall within the true spirit and scope of the invention.

What is claimed is:

1. A mobile toy comprising:

a plurality of body shells, each being shaped to resemble a different vehicle type;

a chassis to which any one of the plurality of body shells is selectively and detachably coupled;

siren sound generating means, mounted on the chassis, for producing a plurality of siren sounds, each being selectable to correspond to a selected and coupled one of the plurality of body shells; and a plurality of means for activating said sound generating means, each of said plurality of means activated by a different one of said body shells.

2. A mobile toy according to claim 1, further comprising complimentary coupling means provided on the chassis and the plurality of body shells for detachably coupling any one of the plurality of body shells to the chassis.

3. A mobile toy according to claim 2, wherein the complimentary coupling means includes a plurality of patterned projections and recesses.

4. A mobile toy according to claim 1, further comprising drive means coupled to a plurality of wheels and being carried by the chassis for driving the chassis.

5. A mobile toy according to claim 4, wherein the drive means includes a power source electrically coupled to an electric motor, and transmission gearing coupled to an output of the electric motor for driving at least one of the wheels.

6. A mobile toy according to claim 5, wherein the transmission gearing includes a gear movable into and out of a drive train defined by the transmission gearing and the electric motor, so as to selectively engage and disengage the at least one driven wheel from the electric motor.

7. A mobile toy according to claim 6, further comprising a knob slidable between on and off positions and engaging the movable gear.

8. A mobile toy according to claim 7, further comprising a power on/off switch which is actuated by the knob.

9. A mobile toy according to claim 8, further comprising a second power on/off switch, and being actuated by magnetic force.

10. A mobile toy according to claim 9, further comprising a doll having magnetic material disposed in a base portion of the doll, a pair of electroconductive contact pieces disposed within the chassis, and a pivotal lever mounted for pivotal movement over the pair of electroconductive contact pieces and carrying a permanent magnet at one end thereof, the permanent magnet being attracted to the magnetic material of the doll so as to cause actuation of the second power on/off switch when the doll is placed is proximity to the lever.

11. A mobile toy according to claim 1, wherein the siren sound generating means includes a plurality of sound switches coupled to a voice synthesizing I.C., the type of siren sound produced by the I.C. being determined by a condition of the sound switches.

12. A mobile toy according to claim 11, wherein the sound switches correspond to individual ones of the plurality of body shells so that the sound switches are actuated in accordance with the body shell coupled to the chassis.

13. A mobile toy according to claim 12, wherein each sound switch comprises a contact piece which is normally in an open condition, and a plurality of pivotal levers are mounted in proximity to corresponding ones of the contact pieces.

14. A mobile toy according to claim 13, wherein all but one of the plurality of body shells has a projection disposed in a position different body shell, each projection corresponding to one of the sound switches and engaging corresponding ones of the pivotal levers.

15. A mobile toy according to claim 14, wherein the voice synthesizing I.C. makes a first siren sound when all of the sound switches are in an open position, a second siren sound when one of the sound switches is in a closed position, a third siren sound when two of the sound switches are in closed positions, and a fourth siren sound when three of the sound switches are in closed positions.

16. A mobile toy according to claim 1, further comprising a power source, an electric motor, and a transmission, wherein the chassis includes a driven axle having wheels mounted on opposite ends thereof and the transmission is coupled between the axle and the motor.

17. A mobile toy according to claim 16, wherein the transmission includes a ratchet gear which breaks a drive train defined by the transmission and the motor when the wheels are prevented from rotating.

18. A mobile toy according to claim 16, wherein the transmission includes a slidable gear movable between engaged and disengaged positions so as to engage and disengage the axle from the motor.

* * * * *